US008789785B2

(12) United States Patent
Lelas et al.

(10) Patent No.: US 8,789,785 B2
(45) Date of Patent: Jul. 29, 2014

(54) DEVICE FOR MICRONIZATION OF SOLID MATERIALS AND ITS USE

(75) Inventors: Antonio Lelas, Zagreb (HR); Marijan Ramljak, Zagreb (HR); Ivica Cepanec, Kriz (HR); Alojz Drvar, Zagreb (HR)

(73) Assignee: Lambano Trading Limited, Limassol (CY)

( * ) Notice: Subject to any disclaimer, the term of this patent is extended or adjusted under 35 U.S.C. 154(b) by 22 days.

(21) Appl. No.: 13/811,702

(22) PCT Filed: Aug. 19, 2011

(86) PCT No.: PCT/HR2011/000033

§ 371 (c)(1),
(2), (4) Date: Jan. 23, 2013

(87) PCT Pub. No.: WO2012/025770

PCT Pub. Date: Mar. 1, 2012

(65) Prior Publication Data

US 2013/0119174 A1 May 16, 2013

(30) Foreign Application Priority Data

Aug. 23, 2010 (HR) ..... P 20100464 A

(51) Int. Cl.
*B02C 13/00* (2006.01)

(52) U.S. Cl.
USPC ..... 241/188.1

(58) Field of Classification Search
USPC ..... 241/188.1, 261.2, 261.3
See application file for complete search history.

(56) References Cited

U.S. PATENT DOCUMENTS

| | | | | |
|---|---|---|---|---|
| 2,414,361 | A * | 1/1947 | Cowles | 241/55 |
| 3,411,724 | A * | 11/1968 | Noe | 241/188.2 |
| 3,894,695 | A | 7/1975 | Benedikter | |
| 4,406,409 | A * | 9/1983 | Durek | 241/5 |
| 4,522,342 | A | 6/1985 | Müschenborn et al. | |

(Continued)

FOREIGN PATENT DOCUMENTS

| | | | |
|---|---|---|---|
| DE | 3429365 | A1 | 11/1985 |
| EP | 0 276 742 | A2 | 8/1988 |
| HR | P990263 | A2 | 8/1999 |
| WO | WO 00/64586 | | 11/2000 |

OTHER PUBLICATIONS

International Search Report for PCT/HR2011/000033 mailed Feb. 14, 2012.

(Continued)

*Primary Examiner* — Faye Francis
(74) *Attorney, Agent, or Firm* — RatnerPrestia

(57) ABSTRACT

A device for increased micronization efficiency of solid materials. The device including a housing with two discs, separately driven by motors through axles, such that the discs rotate in opposite directions. Each of discs bears at least two or more wreaths of blades such that two adjacent wreaths that belongs to different discs do rotate, relatively one to another, in opposite directions, forming an area where micronization of material takes place. The wreaths of blades of different discs are faced one against another. All blades of wreaths are identical, in the shape of a "T", and include three wings; two wings are dimensionally identical and set under the right angle, whereas the third wing is set dimensionally larger than the other wings. Centerline of all three wings meet each other in the center of the blade, on a circle that goes through half of the wreath.

4 Claims, 4 Drawing Sheets

(56) References Cited

U.S. PATENT DOCUMENTS 5,009,371 A * 4/1991 Nickel ..... 241/187
5,174,512 A 12/1992 Orlandi
5,597,127 A * 1/1997 Brown ..... 241/188.2
6,435,433 B1 * 8/2002 Hesch ..... 241/186.35
7,992,816 B2 * 8/2011 Wang ..... 241/188.1

OTHER PUBLICATIONS

Written Opinion of the International Search Authority for PCT/HR2011/000033 mailed Feb. 14, 2012.

* cited by examiner

DEVICE FOR MICRONIZATION OF SOLID MATERIALS AND ITS USE

CROSS REFERENCE TO RELATED APPLICATIONS

This application is the U.S. National Phase Application of PCT/HR2011/000033, filed Aug. 19, 2011, which claims priority to Croatian Patent Application No. P2010046A, filed Aug. 23, 2010, the contents of such applications being incorporated by reference herein.

FIELD OF THE INVENTION

The present invention relates to improved device for micronization of solid materials which is based on the concept of disintegrator, and to its use.

TECHNICAL PROBLEM

Basic technical problem which is solved by the present invention is novel construction geometry of hitting elements (blades) of already known device for micronization of solid materials, based on the concept of disintegrator with two opposite rotating discs bearing said blades.

Second technical problem solved by the present invention is relative position of the blades with new shape on wreaths of the discs which perform micronization, with the goal to increase efficiency of the micronization process.

PRIOR ART

Milling is one of basic technological operations of chemical, food-processing, construction, and many other industries, wherein material is grinding to various fine levels of granulation or particles size.

Micronization is highly-effective kind of milling which provides direct production of very fine particles, typically from 5-50 μm, from starting material of relatively coarse particle size, e.g. 0.1-1 mm.

Technological operation of micronization is widely employed in production of active substances and excipients for pharmaceutical, cosmetic, and agrochemical industries; also in chemical industry (e.g. fillers, pigments), as well as many other fields.

Micronization can be carried out by prolonged milling in different kinds of classical mills, wherein the milling process is mainly effected by the collisions of particles of material being milled with hitting elements of device [A. D. Salman, M. Ghadiri, M. J. Hounslow: Handbook of powder technology, Vol. 12, Particle Breakage (2007) Elsevier]: (i) ball mill; (ii) rod mill; (iii) hammer mill; or (iv) vibration mill.

For each of mentioned mill concepts, there can be find improved versions in the literature [e.g. for ball mill, T. Orlandi: Grinding Process and a Continuous High-Capacity Micronizing Mill for its Implementation, U.S. Pat. No. 5,174,512 (1992) Snamprogetti S.p.A.].

Far more effective technics of micronizations are those predominantly based on mutual collisions of particles of material being micronized: (i) in suspension (wet milling) in colloidal mill; (ii) by dry milling in so-called jet-mill, which affects milling due to high number of particles collisions in the flow of compressed air [H. G. Zander, H. Bornefeld, B. M. Holl: Process and Device for Micronizing Solid Matter in Jet Mills, EP0276742 (1994) Bayer AG]; or in (iii) disintegrator

[D. Muschenborn, R. Rautenbach: Impact Mill, U.S. Pat. No. 4,522,342 (1985); T. Lelas: Device for micronizing materials, HR990263 A2 (1999)].

The present invention involves an improved version of micronization device based on the concept of disintegrator, as described in the prior art [e.g. T. Lelas: Device for micronizing materials, HR990263 A2 (1999)].

Said disintegrator is based on the concept of two opposite discs which rotate by high speed in opposite directions. Discs bear certain hitting elements, blades, which mill/micronize particles of material during their passage through the device. Also, they provide high number of mutual collisions of particles of the material being micronized.

In the literature there are described devices with various shapes of the blades on the discs: (i) round-shaped blades; (ii) cubic-shaped blades; (iii) blades in the shape of elongated plates; and (iv) blades in the shape of slightly curved plates, without or with additional particular mechanic details (e.g. indented hitting surface) which eventually improve course of micronization process.

Such device is shown in FIG. 1, and its section wherein two layers (wreaths) of blades on each of opposite discs, and the entrance of material into central part of micronization device can be seen in FIG. 2.

THE SUMMARY OF INVENTION

To solve said technical problems, the device for micronization of solid materials as shown in the FIG. 1 was built. The device comprises of housing wherein two discs are placed; these are independently driven through axles by the way that said discs rotate in opposite directions. On each of the discs there are at least two or more wreaths of blades. Two neighbouring wreaths which belong to different discs do rotate, relatively one to another, in opposite directions, thus forming an area wherein the micronization is taking place.

Wreaths of blades of different discs are faced one against another, in the manner that all wreaths of blades are identical, in the shape of the letter "T". The blades are consisting of three wings, where two wings are dimensionally identical and placed under the right angle, whilst the third wing is dimensionally larger than the two former wings. Centerline of all three wings meet each other in the center of the blade, on the circle that goes through the half of the wreath.

The position of blade on each of discs is constructed by the way that one shorter wing of the blade is leaned for angle β in the rotating direction of the wreath, in relation to tangent which goes through the center of the blade. The angle β is 120°-140°. All blades of the same wreath are leaned in the same direction.

DETAILED DESCRIPTION OF THE INVENTION

The present invention is shown in the FIGS. 1-8.

Figure 1:
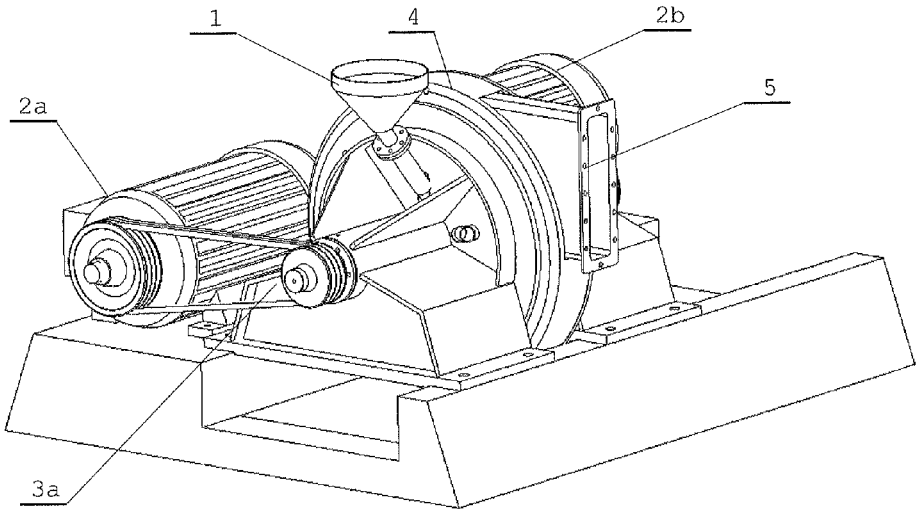
FIG. 1. shows the micronization device, which is from outside the same in prior art as in the present invention.
Figure 2:
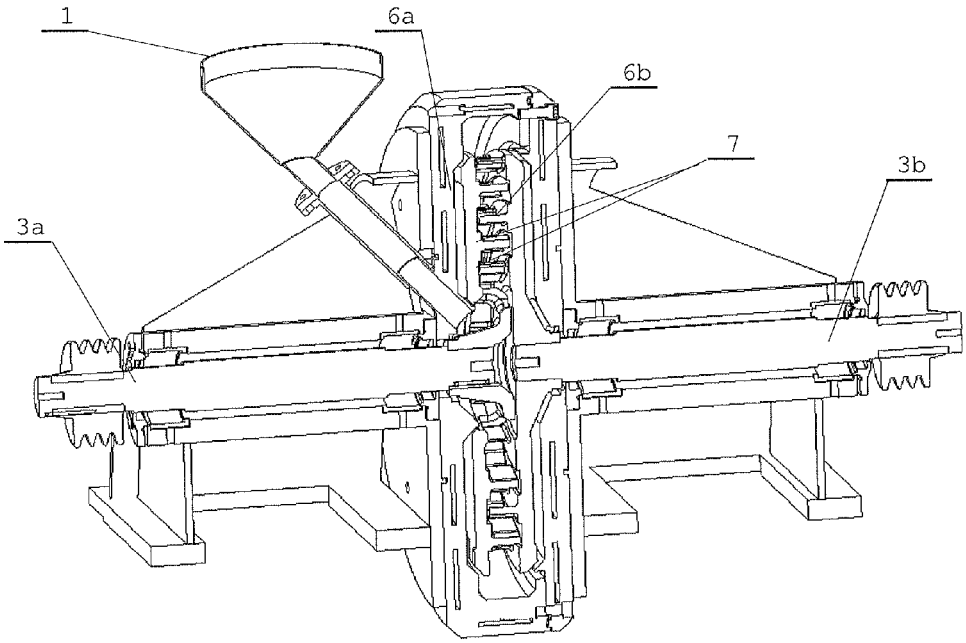
FIG. 2. shows the section of micronization device. Herein are visible opposite discs, hitting elements (blades) on discs positioned in two layers (wreaths), and the manner how wreaths of blades from one disc, during closing of the micronization device housing, entrance between the wreaths of blades on the opposite disc.

FIGS. 1 and 2 show one of possible way of realization of the present invention. The micronization device is known and constructionally identical to the device described in the prior art, for instance in Croatian patent application HR990263.

In housing (4) of the device, there are positioned two discs (6*a*, 6*b*), independently driven by motors (2*a*, 2*b*) through axles (3*a*, 3*b*) in a way that said discs (6*a*, 6*b*) do rotate in opposite directions; on each of discs (6*a*, 6*b*) there are positioned at least two or more wreaths of blades (8*a*, 8*b*) in such a manner that two neighbouring wreaths which belongs to different discs do rotate, relatively one to another, in opposite directions, thus forming an area wherein micronization of material is taking place; wreaths of blades (8*a*, 8*b*) of different discs (6*a*, 6*b*) are faced one against another.

Figure 3:
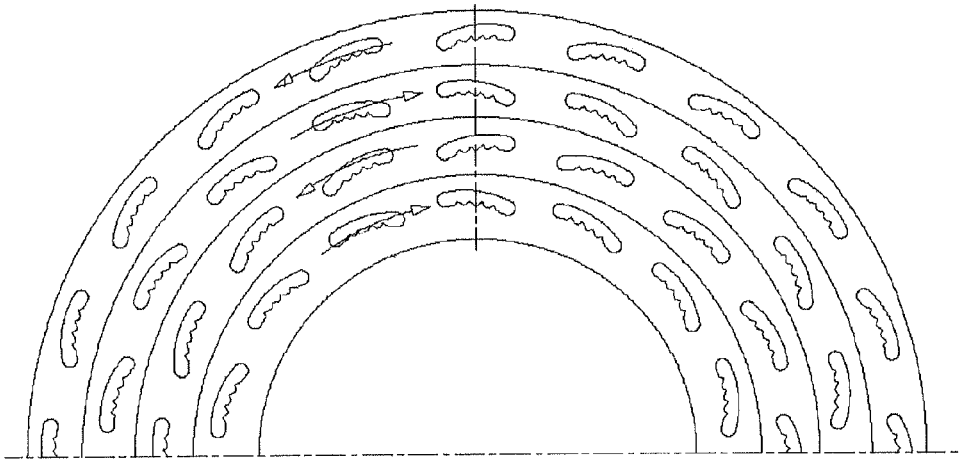
FIG. 3. shows a half of the disc from the prior art with blades in the shape of slightly curved and indented plates, as well as their arrangement.

FIG. 3 shows the prior art, specially the shape and arrangement of blades according to the invention described in HR990263.

Figure 4:
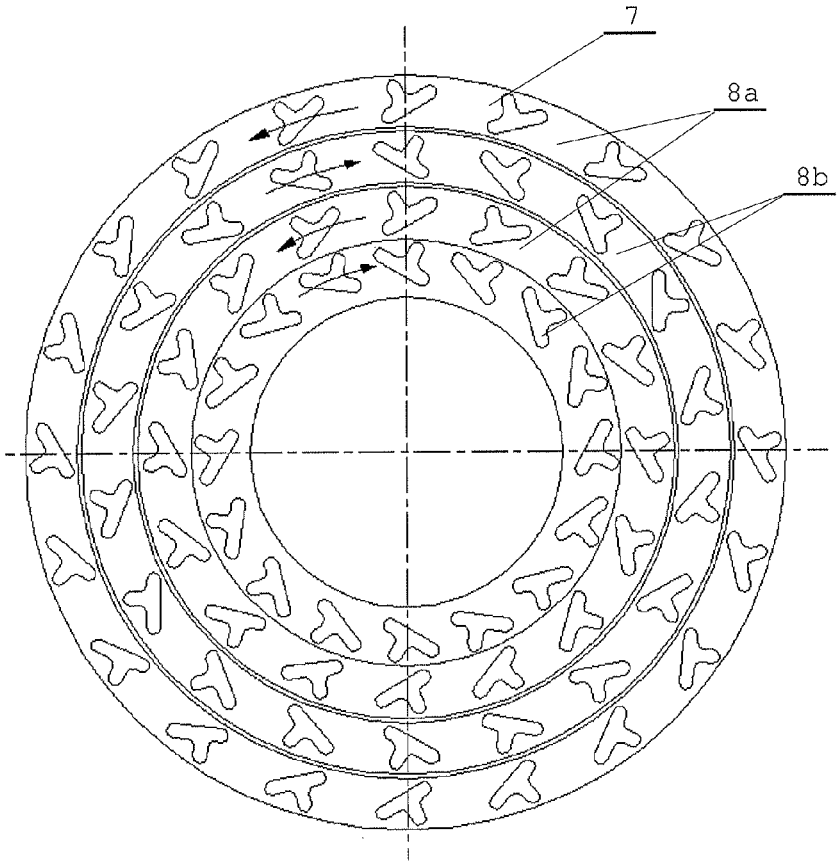
FIG. 4. shows the disc from the present invention with blades in the shape of the letter "T", and their arrangement.
Figure 5:
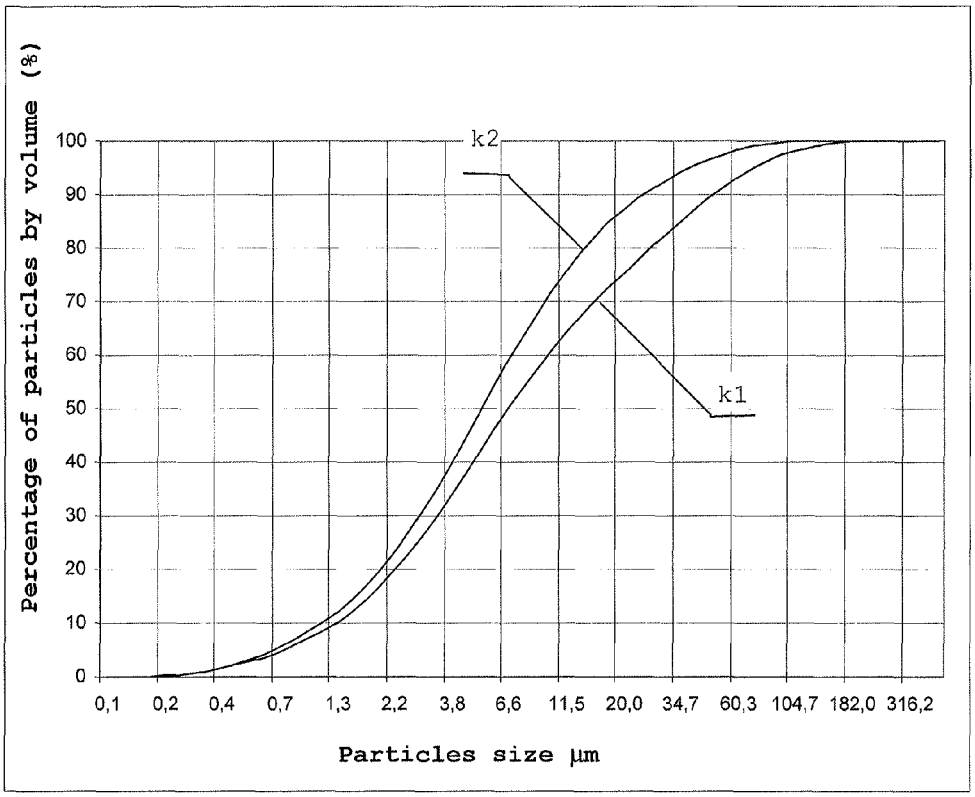
FIG. 5. shows results of particles size analyses of model substance (limestone mineral; chiefly $CaCO_3$) micronized with the use of discs with blades in the shape of slightly curved and indented plates from the prior art (curve k1 from Experiment 1), and with the use of discs with blades in the shape of the letter "T" from the present invention (curve k2 from Experiment 2).

On the FIG. 4, there is shown the shape of blades (7) from the present invention and their arrangement within the micronization device. Blades (7) are organized in the wreaths of blades (8*a*, 8*b*) which belongs to discs (6*a*, 6*b*). Each disc (6*a*) or (6*b*) contains minimally two or more wreaths (8*a*) or (8*b*). On each of wreaths there are number of blades (7) which depends on diameter of the wreath.

Figure 7:
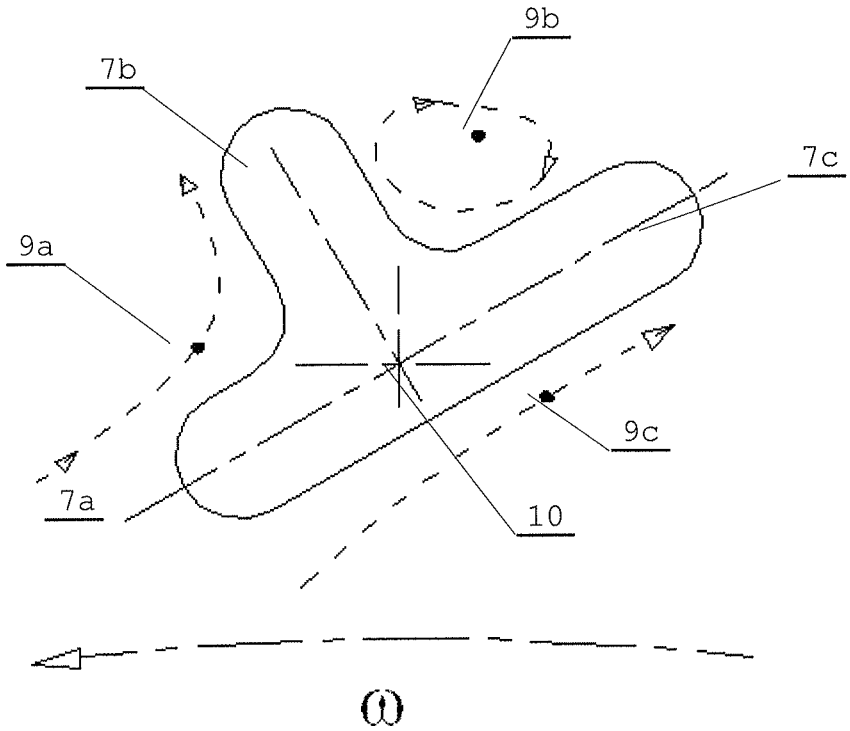
FIG. 7. shows the flow of particles of material being micronized around the blade in the shape of the letter "T" from the present invention.

All blades (7) of wreaths (8*a*, 8*b*) are identical, of the shape of the letter "T", and comprise of three wings (7*a*, 7*b*, 7*c*) (FIG. 7). Wings (7*a*) and (7*b*) are dimensionally identical and positioned under the right angle, whereas the wing (7*c*) is dimensionally larger from the wings (7*a*, 7*b*); also centerline of all three wings meet each other in the center of the blade (10), on the circle which goes through the half of the wreath (8*a*, 8*b*).

Figure 8:
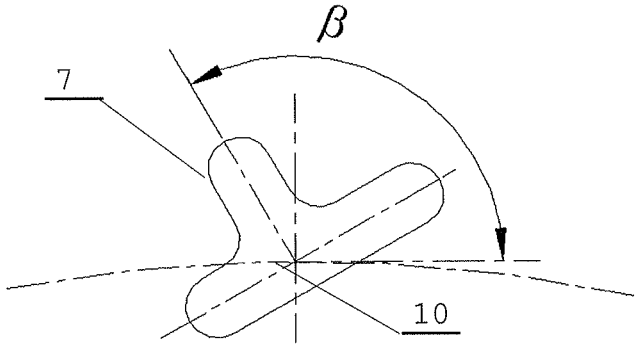
FIG. 8. describes the angle of distortedness (β) of blade in the shape of the letter "T", under which it is fixed on each of discs in the present invention.

FIG. 8 shows arrangement of blades (7) on wreath (8*a*, 8*b*) in such a manner that wing (7*a*), in relation to the tangent that goes through the center of the blade (10), is leaned for the angle β to the rotating direction of the wreath (8*a*, 8*b*); the angle β is 120°-140°, and all blades (7) of the same wreath (8*a*, 8*b*) are leaned in the same direction.

EXAMPLES OF REALIZATION OF THE INVENTION

Course of micronization process in the device from the present invention is the same as in the device from the prior art given on the FIGS. 1 and 2. Material being micronized is added to the dosing basket (1). The latter brings material into the central part of rotating discs, in the area of micronization, visible in the FIG. 2. Due to a strong centrifugal force, particles of material being micronized pass through two or more wreaths (8*a*, 8*b*) of rotating blades (7) of opposite discs (6*a*, 6*b*) by high speed. During this, a huge number of collisions between particles and material of the micronizer, above all of blades, as well as mutual collisions of particles take place.

The influence of the shape of blades on efficiency of micronization has been studied by the use of micronization device shown in FIGS. 1 and 2 of the following technical characteristics:

(i) diameter of discs (Ø) of micronizer was 500 mm;

(ii) number of wreaths (8*a*, 8*b*) of blades (7) on each of discs was 2;

(iii) number of blades (7) on each of wreaths (8*a*, 8*b*) of discs was 20/16 (outern/inner wreath) from one sides; and 18/16 (outern/inner wreath) from the other side of the micronization device;

(iv) rotation speed of discs was 5000 rotations-per-minute (rpm);

(v) micronization device was equipped with two same electromotors of 30 kW power which work at 380 V and frequency of 50 Hz; and (vi) power transmission from the axles of electromotors to axles of micronization device was accomplished by use of transmission belts (analogously to FIG. 1).

Natural limestone mineral, chiefly calcium carbonate ($CaCO_3$) by chemical composition, was selected as a model substance of hardness of 3 according to Mohs' scale. Starting material was of nominal particles size of 0-1 mm, of average particle size of 0.3-0.5 mm, which is commercially available as fine mineral filler for production of construction adhesives, plasters, etc.

Per 1 kg of thus samples of limestone mineral were micronized by the use of the device from the prior art shown in FIGS. 1 and 2 characterized by above-mentioned technical data with the only difference in the shape of blades on discs:

(i) slightly curved and indented plates (FIG. 3; Experiment-1); and (ii) in the shape of the letter "T" from the present invention (FIG. 4; Experiment-2).

Such prepared samples of micronized limestone mineral were subjected to particles size analyses by using Master-Sizer 2000 (Malvern instruments) instrument. Results of Experiment-1 and Experiment-2 were shown in Table 1, and graphically in FIG. 5.

TABLE 1

Influence of the shape of hitting elements (blades) of disc of micronization device (FIGS. 1 and 2) on efficacy of micronization process of model substance (limestone mineral) of average particles size of 0.3-0.5 mm. In experiment-1 there was used discs (6a, 6b) with blades (7) in the shape of slightly curved and indented plates (FIG. 3), whilst in the experiment-2 was employed discs (6a, 6b) with blades (7) in the shape of the letter "T" (FIG. 4).

| Particles size (μm) | EXPERIMENT-1 Volume percentage (%) under | EXPERIMENT-2 Volume percentage (%) under |
|---|---|---|
| 0.138 | 0.00 | 0.00 |
| 0.158 | 0.02 | 0.00 |
| 0.182 | 0.07 | 0.00 |
| 0.209 | 0.15 | 0.00 |
| 0.240 | 0.28 | 0.12 |
| 0.275 | 0.46 | 0.32 |

TABLE 1-continued

Influence of the shape of hitting elements (blades) of disc of micronization device (FIGS. 1 and 2) on efficacy of micronization process of model substance (limestone mineral) of average particles size of 0.3-0.5 mm. In experiment-1 there was used discs (6a, 6b) with blades (7) in the shape of slightly curved and indented plates (FIG. 3), whilst in the experiment-2 was employed discs (6a, 6b) with blades (7) in the shape of the letter "T" (FIG. 4).

| Particles size (μm) | EXPERIMENT-1 Volume percentage (%) under | EXPERIMENT-2 Volume percentage (%) under |
|---|---|---|
| 0.316 | 0.71 | 0.62 |
| 0.363 | 1.05 | 1.04 |
| 0.417 | 1.51 | 1.62 |
| 0.479 | 2.11 | 2.36 |
| 0.550 | 2.82 | 3.24 |
| 0.631 | 3.66 | 4.28 |
| 0.724 | 4.63 | 5.46 |
| 0.832 | 5.74 | 6.80 |
| 0.955 | 7.00 | 8.31 |
| 1.096 | 8.44 | 10.02 |
| 1.259 | 10.10 | 11.97 |
| 1.445 | 12.00 | 14.20 |
| 1.660 | 14.19 | 16.76 |
| 1.905 | 16.70 | 19.67 |
| 2.188 | 19.53 | 22.95 |
| 2.512 | 22.69 | 26.63 |
| 2.884 | 26.15 | 30.66 |
| 3.311 | 29.88 | 35.03 |
| 3.802 | 33.82 | 39.65 |
| 4.365 | 37.89 | 44.46 |
| 5.012 | 42.02 | 49.35 |
| 5.754 | 46.11 | 54.23 |
| 6.607 | 50.10 | 58.99 |
| 7.586 | 53.93 | 63.57 |
| 8.710 | 57.56 | 67.90 |
| 10.000 | 60.98 | 71.94 |
| 11.482 | 64.18 | 75.64 |
| 13.183 | 67.19 | 79.02 |
| 15.136 | 70.02 | 82.04 |
| 17.378 | 72.71 | 84.74 |
| 19.953 | 75.27 | 87.12 |
| 22.909 | 77.75 | 89.23 |
| 26.303 | 80.17 | 91.08 |
| 30.200 | 82.55 | 92.72 |
| 34.674 | 84.89 | 94.17 |
| 39.811 | 87.16 | 95.45 |
| 45.709 | 89.34 | 96.56 |
| 52.481 | 91.39 | 97.51 |
| 60.256 | 93.25 | 98.31 |
| 69.183 | 94.88 | 98.96 |
| 79.433 | 96.25 | 99.46 |
| 91.201 | 97.35 | 99.81 |
| 104.713 | 98.20 | 99.96 |
| 120.226 | 98.84 | 100.00 |
| 138.038 | 99.31 | 100.00 |
| 158.489 | 99.65 | 100.00 |
| 181.970 | 99.86 | 100.00 |
| 208.930 | 99.98 | 100.00 |
| 239.883 | 100.00 | 100.00 |
| 275.423 | 100.00 | 100.00 |
| 316.228 | 100.00 | 100.00 |
| 363.078 | 100.00 | 100.00 |

The results showed unexpectedly increasing of efficacy of micronization process due to the use of the new design of blades in the shape of the letter "T" on the discs of the device. Increasing of efficacy of micronization process expressed as a ratio of:

(i) percentage of particles by volume (volume percentage; % V/V) of model substance (limestone mineral; of the same starting average particles size of 0.3-0.5 mm) given against the particles size (as diameter in μm) at the use of discs with blades from the present invention (FIG. 4); and (ii) volume of analogous particles of the product obtained with the use of discs with blades from the prior art (FIG. 3);

at particles size of 1, 5 i 10 μm were 17-19% (Table 2).

TABLE 2

Increasing of efficacy of micronization due to the use of blades (7) on discs (6a, 6b) of micronization device in the shape of the letter "T" expressed through enhancement of volume percentage of fine (1, 5, 10 μm) particles.

| Particles size (μm) | EXPERIMENT-1: Percentage (%) of particles by volume | EXPERIMENT-2: Percentage (%) of particles by volume | Increasing of efficacy (%)[1] |
|---|---|---|---|
| 1.096 | 8.44 | 10.02 | 18.7 |
| 5.012 | 42.02 | 49.35 | 17.4 |
| 10 | 60.98 | 71.94 | 18.0 |

[1]Ratio between percentages by volume (% V/V) of particles of analogous size obtained by the use of discs with blades from the prior art (FIG. 3; Experiment-1), and with discs containing blades in the shape of the letter "T" from the present invention (FIG. 4; Experiment-2).

From these results, unexpectedly positive effect of the new design of hitting elements, blades (7), on the discs (6*a*, 6*b*) of the micronization device is clear to those skilled in the art; this new design of the blades resulted in increasing of micronization efficiency of 17-19%.

Explanation of Increase of Micronization Process Efficiency Due to the Use of Blades in the Shape of the Letter "T"

Figure 6:
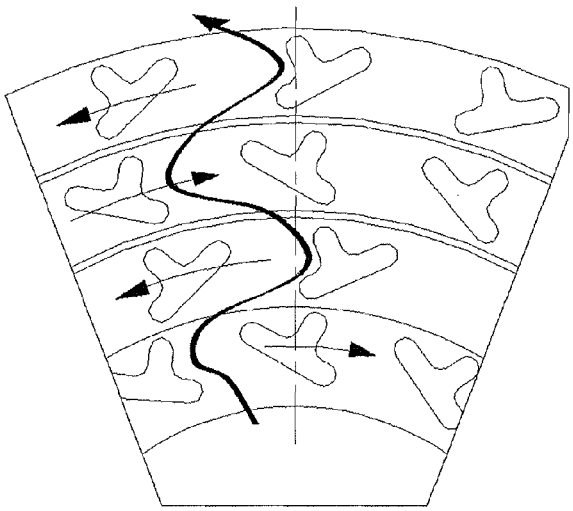
FIG. 6. shows, the direction flow of particles of material passing through micronization device from the present invention.

At rotation of the discs (6*a*, 6*b*) of the device by external force, particles of a fluid pass from central part of discs toward their (outern) edges of hats, as shown in FIG. 6. This is accompanied with increasing of fluid energy. The fluid in the micronization device is an air which is, in the same time, a carrier of the particles of the material being micronized. The increasing of energy is manifested in:

(i) enhanced pressure at the exit of the micronization device; and in (ii) increased absolute velocity of particles.

How the energy will raise in one or another form depends on the distortedness (position) of the blades.

In the FIG. 7, there is shown possible processes of flowing of particles of material at the use of the blades in the shape of the letter "T" on the discs (ω=rotating direction) in the micronization device from the present invention:

(i) particles of material being micronized, in the moment of the contact with next wreath (8*a*, 8*b*) of blades (7), do collide with them at approximately right angle, providing maximal positive impact on micronization process (zone 9*a*);

(ii) part of the particles flow is directed with a tail of the blade onto the next blade (zone 9*b*), and (iii) vortical flowings favour mutual collisions of particles in the zone marked as 9*c*.

It seems that the major effect of blades (7) from the present invention is not increasing the energy to the fluid by minimal energy looses, what is the case at e.g. pumps or classical ventilators, but, with the shape of the blade, power energy mainly spend in a controlled manner on generation of turbulent areas (FIG. 7; position like that of zone 9*c*), wherein the mutual collisions of particles take place.

The blades from the present invention in the shape of the letter "T" (FIGS. 4, 7 and 8) are fixed on discs of the micronization device in such position that they are leaned towards, meaning in the rotation direction under the angle β of 120-140°, to provide:

(i) reaching of maximal velocity of the fluid at given level of energy; and (ii) occurrence of turbulent flowings that result in high frequency of mutual collisions of particles being micronized.

Described towards leaned position of the blades ($\beta=\beta_{max}$), shown in FIG. 8, enables transfer of two times more energy to the fluid than at blades that are distorted in a radial direction wherein $\beta=\pi/2$. Overall energy that is given to the fluid is contained in the velocity. Increasing of the distortedness angle ($\beta$) of the blades to 120-140°, absolute velocity of particles at the exit is elevated for 20-40%, in comparison to radial blades ($\beta=90°$).

The Use of Micronization Device from the Present Invention

It was found that average particles size of entering material being micronized in the present device can be between 0.1-0.5 mm at smaller, laboratory devices with diameter (Ø) of discs <500 mm. At larger devices with diameter of discs >500 mm, it can be 0.1-3 mm. The best option is to use starting materials with average particles size between 0.1-0.5 mm, what is usual in industry where these products are firstly subjected to coarse milling in some kind of ordinary mills like ball mills. Of course, here can be used starting materials with average particles size of smaller than 0.1 mm, what results in significant additional enhancement of micronization process efficiency.

Improved micronization device from the present invention was built from stainless steel 316. This device was successfully employed for micronization of wide variety of organic and inorganic substances which are of lower level of hardness according to Mohs scale (<5-6). When the hitting elements (blades) were built from very hard materials like tungsten carbide, the device from the present invention was successfully employed also for micronization of even harder substances which are in the Mohs scale ≥7, as achieved with the sand (quartz). Alternatively, basic material of micronization device blades, stainless steel 316, can be coated with the layer of tungsten carbide with almost the same improvements.

Improved micronization device from the present invention is successfully used for milling of pure substances or mixtures of several substances, which are, according to their chemical composition: (i) inorganic; (ii) organic; or (iii) mixed composition of organic and inorganic substances; from the classes of raw materials, intermediates or final products in pharmaceutical, cosmetic, food, agrochemical or construction industry, then in various kinds of chemical industries, agriculture, and in other fields of production.

For instance, the device can be effectively used in the production of active substances and excipients for pharmaceutical, food, and agrochemical industry.

As an example of pharmaceutically active substance herein is mentioned anti-inflammatory substance alclometasone-17, 21-dipropionate which was successfully micronized with the device from the present invention yielding the product of increased bioavailability.

Additionally, as an example, here mentioned natural limestone mineral (chiefly $CaCO_3$) contained small amounts of silicon dioxide in the form of quartz ($SiO_2$). Commercially available limestone with average particles size of 0.1-0.5 mm, can be directly processed by the use of the micronization device from the present invention into highly micronized material of average particles size of <10 μm with approx. 10% of particles bellow 1 μm, what is very close to the area of nano-particles (e.g. the product from Example 1). Such product, applied on plants by foliar spraying as 0.5-2% aqueous suspension, provides a profound effects of calcium ($Ca^{2+}$; from calcium carbonate) and silicon (Si; from quartz) fertilization. Analogous application of limestone mineral of commercially available particles size does not exhibit any physiological effects on plants.

Herein mentioned examples of the use of the micronization device from the present invention are only illustrative and do not include all possible technical applications.

EXAMPLES

General Remarks

For testing of the influence of the shape of blades (7) on discs (6*a*, 6*b*), the device with discs diameter (Ø) of 500 mm was used (FIG. 1). The number of blades (7) on discs (6*a*, 6*b*) was 20/16 (outern/inner wreath) from one sides, and 18/16 (outern/inner wreath) on the other side of micronization device. The velocity of discs rotation was 5000 rotations-per-minute (rpm). Micronization device was equipped with two identical 30 kW power electromotors that work at 380 V and frequency of 50 Hz. The power transfer from the electromotors axles onto micronization device axles was accomplished by the use of transmission belts.

Particles size analyses were carried out on the MasterSizer 2000 instrument (Malvern Instruments).

Example 1

Study of Influence of the Shape of Blades on Discs of Micronization Device on Efficacy of Micronization Per 1.00 kg of limestone mineral (chiefly calcium carbonate; $CaCO_3$) as model substance of average particles size of 0.3-0.5 mm, was subjected to micronization by the use of the device from the prior art shown in FIGS. 1 and 2, whilst:

(i) in experiment-1 were employed discs (6*a*, 6*b*) with blades in the shape of slightly curved and indented plates (FIG. 3) known from the prior art; and (ii) in experiment-2 were used discs (6*a*, 6*b*) with blades in the shape of the letter "T" (FIG. 4) according to the present invention.

Such prepared samples of micronized limestone mineral were subjected to particles size analyses. Results are given in Tables 1 and 2, and graphically in FIG. 5.

| References: | |
|---|---|
| 1 | dosing basket |
| 2a, 2b | motors |
| 3a, 3b | axles |
| 4 | housing |
| 5 | opening for exit of micronized material |
| 6a, 6b | discs |
| 7 | blade |
| 7a, 7b, 7c | wings of the blade |
| 8a, 8b | wreaths of blades |
| 9a, 9b, 9c | zones of vortical flowing of particles (around the blade) |
| 10 | center of the blade |

The invention claimed is:

1. A device for micronization of solid materials comprising a housing in which are positioned two discs, independently driven by respective motors through respective axles such that said discs rotate in opposite directions; on each of said discs are at least two or more wreaths of blades distributed such that two neighboring wreaths, which belong to different discs, rotate, one relative to the other, and in opposite directions, thus forming an area where micronization of material is taking place, and the wreaths of blades of different discs are faced one against another, wherein all blades of the wreaths are identical, having the shape of the letter "T" comprising three wings, where two of the three wings are dimensionally identical and positioned under the right angle, whilst a third of the three wings is dimensionally larger than the two wings, and where centerlines of all three wings intersect in a center of the blade, on a circle that goes through half of the wreath.

2. A device for micronization of solid materials according to the claim 1, wherein, a position of the blade on the wreath is defined such that the second wing, in relation to a tangent that goes through the center of the blade, is leaned at an angle β towards the rotation direction of the wreath, where the angle β is 120°-140°, and where all the blades of the same wreath are leaned in the same direction.

3. A device for micronization of solid materials according to claim 1, for micronization of inorganic and organic solid materials.

4. A device for micronization of solid materials according to claim 2, for micronization of inorganic and organic solid materials.

* * * * *